US005084976A

United States Patent [19]

Ross

[11] Patent Number: 5,084,976

[45] Date of Patent: Feb. 4, 1992

[54] BONING KNIFE

[76] Inventor: Dale R. Ross, Rte. 4, Box 157AA, Council Bluffs, Iowa 51501

[21] Appl. No.: 298,877

[22] Filed: Jan. 18, 1989

Related U.S. Application Data

[63] Continuation of Ser. No. 707,759, Mar. 4, 1985, abandoned, which is a continuation-in-part of Ser. No. 431,349, Mar. 23, 1983, abandoned.

[51] Int. Cl.[5] ..... B26B 7/00

[52] U.S. Cl. ..... 30/276

[58] Field of Search ..... 30/276, 316, 337, 127.3

[56] References Cited

U.S. PATENT DOCUMENTS 4,198,750 4/1980 Bettcher ..... 30/276

4,324,043 4/1982 McCullough ..... 30/276

*Primary Examiner*—Douglas D. Watts

*Attorney, Agent, or Firm*—Leydig, Voit & Mayer

[57] ABSTRACT

A boning knife comprising a handle, a circular blade housing, and a circular blade carrier by the housing, wherein the circular blade housing is secured to the handle by setscrew means and by interlocking means and/or the handle has a outwardly flared ridge extending laterally of the rearward terminal end of the handle.

20 Claims, 1 Drawing Sheet

BONING KNIFE

This patent application is a continuation of patent application Ser. No. 707,759 filed Mar. 4, 1985, now abandoned, which in turn is a continuation-in-part of patent application Ser. No. 431,349 filed Mar. 23, 1983, now abandoned.

BACKGROUND OF THE INVENTION

The pain of constantly gripping a bloody, sweaty, slippery prior art boning knife for even just the first hours only of employment at cutting meat from bones has been a pain great enough to cause some would-be professional boners to quit the first day.

This well-known problem of the art has existed for decades. For decades, since 1954, the two manufacturers of boning knives have left the exterior dimensions of their marketed products unchanged, as I have been informed. The exterior dimensions of their marketed products have been largely unchanged despite the pain workers have experienced during these decades.

Often professional boners who have "stuck it out" and stayed with this work for years have been forced to quit this good-paying employment and go "looking for work". The reason: They have contracted a handicap in their hands called "tendinitis".

Tendinitis can be a professionally crippling to a boner as a broken leg to a basketball player.

Workers at boning have needed to be saved from this dread prospect of permanent loss of boning employment. But the prior art knife manufacturers have for decades left the exterior dimensions of their marketed products unimproved, to the best of my knowledge.

It is not claimed that the changes in handle shape proposed herein are guaranteed by years of experience to eliminate the problem of tendinitis. But it is proven by experience with the boning knife disclosed herein that much greater hand comfort during boning definitely results. Since such hand pain is known to be from tendon strain, it is logical to expect years of use to result in a marked lessening of crippling tendinitis itself.

It has been discovered that this prior art condition need not be so. It has been discovered that a boning knife can be changed. It can be provided with a hand-anchor-ridge at its rearward end of a size for engaging the backside of the "heel-bone" of the hand to the rear of the small finger.

It has been discovered that with a hand-anchor-ridge at the rear of the handle, hand-anchor-ridge for protrusion beyond the handle of about 0.160 inch, that the average person in hand pain so severe that they feed they must quit from using other conventional boning knives of the present and of the past 30 years can often continue to work if they are changed over from using a conventional prior art boning knife to the knife of this invention.

An objective of the present invention is to provide a hand-anchor-ridge protruding laterally from the rearward end of the handle so that the "bone" behind the small finger of the operator's hand engages the hand-anchor-ridge, making it possible for the operator to hold onto the bloody, sweaty, slippery handle adequately and with less hand-strain.

In the prior art, there has been no grip-ridge at the rearward end of the handle for the purpose of making gripping of the boning knife easier.

For the different purpose of providing extra strength and rigidity at the rearward end of a boning knife handle, there have been thicker areas on boning knife handles at the rearward end. Such a thickening is disclosed as item 45 in U.S. Pat. No. 4,324,034, issued Apr. 13, 1982, to Timothy J. McCullough, titled: HAND PIECE FOR MEAT TRIMMING KNIFE. However, there is no grip-assisting purpose stated for the thickening at item 45 and the dimensions at the thickening provide a protrusion laterally from the side of the handle that is tiny, although suitable for the different purpose stated in the patent. The dimension of such a protrusion, if calculated from the drawings of the patent in terms of its proportions, appears to be less than one-third of the amount of the protrusion proposed for the new grip-ridge hereof.

The boning knives being marketed at this time that have the thickening for strength purposes are found to have a protrusion from the side of the handle of a dimension of about 0.047 inch. The grip-ridge proposed herein has a preferred protrusion dimension of 0.160 inch, over 340% greater in accordance with the new purpose of assisting grip. This indicates that the thickening bead 45 of the McCullough patent, when looked at from the standpoint of assisting grip of the handle, would be a mere accidental disclosure.

In the prior art the thickening or bead could have been accomplished with a protrusion on the inner side of the hollow handle, and it appears that the reason it appears to be on the outside is for a lesser conflict with the drive cable assembly, which latter preferably would engage a surface on the inner side of a handle which would be curved outwardly and rearwardly from a position of being flush with or continuous with the inner surface of the hollow handle. However the hand-anchor-ridge hereof must protrude from the outside of the handle, rather than the inside, in order to serve its different purpose of helping to prevent tendinitis.

During many decades there has been a long-felt need for improvement felt in the aching hands of the boning knife operators during their long hours of work in gripping slippery knives, and also felt by anyone to whom they told their plight, all of whom would be acquainted with the way that boning knives have been constructed in the prior art.

Heretofore the rearward portion of boning knife handles have been smooth and of substantially non-porous, slippery thermoplastic or aluminum material. They have not utilized with knurling at all in this very important location, where the handle is at maximum width and so hand-pressure on the handle at this rear area is great. Therefore, it turns out to be an ideal place for knurling, even though this discovery was overlooked for decades while knurling at the narrow forward neck of the hand-gripped area has been before the eyes of this trade for decades. At the narrow forward neck usually only one finger touches, making the knurling there substantially useless compared to the new rear knurling position thereof.

In the past, boning handles had only one lubricating hole to the right of the center of the handle. In this hole is mounted an upwardly protruding lubrication housing and the right handed operator's thumb is then free to be placed against the left side of the handle top which is the natural position for it. But for the left handed operator the lubrication housing is in the way of his natural thumb position which would then be on the right of center pressing against the handle top. This has handicapped or stopped left handed would-be boners for decades without a solution to this problem. It is an object of this invention to provide two threaded openings in the handle, one on the left for the left-handed operators, and one on the right for right-handed operators, so that the lubrication housing can be disposed out of the left handed operator's thumb position.

Another objective hereof is to provide the knife handle with a smaller diameter at parts gripped by the operator. It has been discovered that this not only relieves tendinitis for people who have smaller hands, but also relieves pain for those who have the largest hands among the operators.

Heretofore, at the rearward portion of handle, there was no knurl, and it is an objective hereof to add knurl for making gripping easier.

In the past, there has only been a light knurling at a forward part of the handle. It is an object of this invention to increase the depth of the knurling at this forward part for much easier gripping.

Unscientific tests conducted by laymen have attempted to show that such knurling provides relief of tendon strain and hence in the long-run helps to prevent tendinitis.

DESCRIPTION OF THE PREFERRED EMBODIMENT

Figure 4:
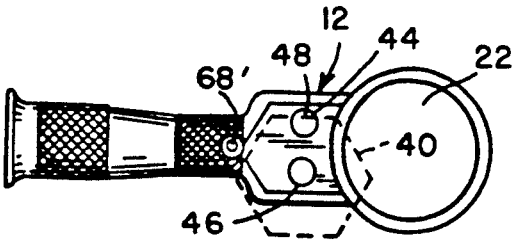
FIG. 4 is a top view

A boning knife assembly generally indicated at 10 having a frame 12 on the forward end of which is mounted a circular blade holder 20 having an open center 22, as seen in top plan view in FIG. 4, whereby the circular blade holder 20 has an interior groove 24 into which the upper portion of a circular boning knife 30 is received rotatably. The lower edge of the knife 30 is sharp and circular as seen at 32.

To the frame 12 a handle generally indicated at 14 is attached, as is conventional. In the frame 12, rearwardly of the knife 32, is an animal fat lubrication housing 40 having a threaded lower end 42 conventionally received in a threaded opening 44 in the frame 12.

However, instead of the opening 44 being in the center of the frame, there are, instead, two openings 44 and 46, which latter are disposed one on the left and one on the right side of the frame 12 at a substantial spacing so as to dispose the bulky animal fat lubrication housing 40, either more to the left or to the right of the center of the handle, so as not to be as interfering with the natural preferred position of the thumb of either a right or a left handed operator.

The left opening 44 is for reception of the housing when a left-handed operator is working and the right opening 46 is for the reception of the housing when a right-handed operator is working. The opening in which the housing 40 is not disposed at any one time is simply plugged up, such as with a plug 48 in FIG. 4.

The handle 14 is provided with an opening rearward end 54 which is continuous with a hollow central portion thereof seen at 56 and a cable 60 extends through the rearward end 54 of the handle and is attached to a fitting 64 at the forward end of the cable. The fitting 64 is provided with a groove 66 for the reception of a set screw 68' which extends down through the top of the handle in a conventional manner. The forward end of the fitting 64 has a gear 68 mounted on it which meshes with teeth 73 on the upper edge of the blade 30 for causing the blade to rotate.

The handle portion 14 of the frame 12 has an outwardly flared portion 72 which can be called a grip-ridge or-hand-anchor-ridge 72. The hand-anchor-ridge 72 surrounds the handle portion 14 at its rearward end and protrudes from its outer side a protrusion dimension which is preferably 0.16 inch.

The hand-anchor-ridge has been found to be very important in relieving hand-strain called "tendinitis" and varying amounts in the size of the hand-anchor-ridge have the effect of making the handle easier and easier to hold, the larger the hand-anchor-ridge is. This is, with the exception, of course, that a hand-anchor-ridge can be excessively large in its protrusion dimension, as an excessively large hand-anchor-ridge would tend to press into the operator's wrist causing discomfort.

The handle portion 14 of the frame 12 has an outwardly flared rearmost portion 72 providing a hand-anchor-ridge on its outer side and which extends about 0.160 inch from the cylindrical surface 74 of the outer side of a rear gripping portion 80 of the handle, the latter is of a smaller diameter than in the prior art, being changed from a prior art diameter of 1.375 inches to the diameter of this invention which is 1.250 inches, as has been found to help greatly in relieving tendinitis.

The reason the outwardly-flared rearmost hand-anchor-ridge portion 72 extends outwardly from the handle by dimension 0.16 inch is because the rearmost outer diameter of the handle is 1.580 inch and, substracting the diameter 1.260 inches from 1.580 inches gives 0.320 inch, but because the protrusion is on two opposite sides of the handle, this dimension 0.320 inch is divided by 2 so that the protrusion of the grip-ridge on any one side is 0.160 inch.

The surface 74 is provided with knurling 82 which is new as it was smooth in the prior art and is of a depth in the range of 0.010 to 0.030 inch.

Forwardly of the rear gripping portion 80 is an inclined gripping portion 90 which is of a frustro-conical shape extending from a diameter continuous with the diameter of the rear gripping portion 80 to a diameter continuous with and the same as the diameter of a cylindrical forward gripping portion 100, which latter has a smaller diameter than has been the case in the prior art, likewise for easier gripping to reduce strain of the tendons of the operator. The forward gripping section 100 is knurled on its outer side, as shown at 102.

The knurling 102 is much deeper than in the prior art and is now in the range of 0.010 to 0.030-inch, whereas formerly it was 0.005-inch.

The outer dimension of the outwardly flared rearmost portion 72 of the handle, as measured from top to bottom, is 1.580 inches.

The distance from the rearmost end of the handle to the knurling 82 is one-half inch. The distance from the rearmost end of the handle to the forward end of the rear gripping portion 80 is 2.312 inches. The distance from the rearward end of the handle to the forward end of the inclined gripping portion 90 is 3.530 inches. The distance from the rearward end of the handle to the forward end of the knurling 102 is 4.312 inches.

Figure 1:
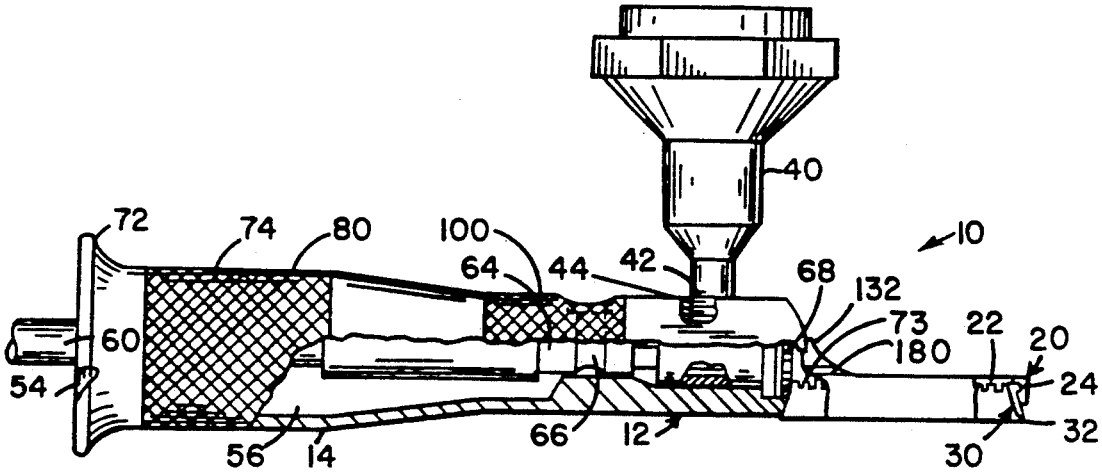
FIG. 1 is a side view
Figure 2:
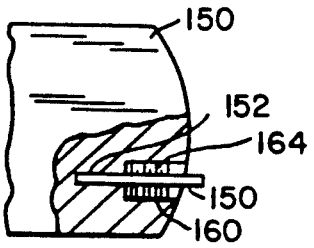
FIG. 2 is a partial view
Figure 3:
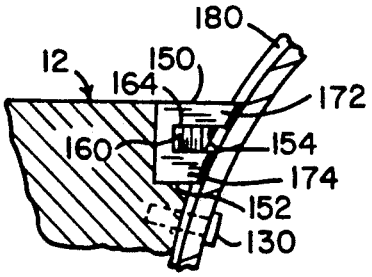
FIG. 3 is another partial view

The circular blade holder 22 is conventionally removable from the frame 12 in boning knives and is held in place by set screws, one of which is shown at 130 in FIG. 3, extending through an upwardly protruding part 132 of circular blade holder 20 and into the frame 12 at its forward side.

However in addition to the holding done by the screws 130, it is important that there be interlocking means between the circular blade holder and the frame 12 and this is provided by right and left inserts 150 which are in slots 152 in the frame 12, and held in by setscrews 160 in threaded holes 164.

The inserts each have a slot 154 in their forward sides, and forward ends lapping into a slot 180 in the part 132 of the holder 20. The inserts can be removed when worn out.

Tests using boning knives with different flared ridge dimensions were carried out as noted below. In tests A, B, C and D, the preferred diameter of the cylindrical rear gripping portion of the handle was used which is the same new smaller 1.250 inch preferred herein.

The new knurling hereof was used at the new position on the rear gripping portion 74 and at a depth of 0.0120 to 0.030 inch in each test of the four.

The inclined portion 90 was smooth in each test of the four.

The forward section 100 was knurled to a depth range of 0.010 to 0.030 inch, in each test of the four.

These four tests each has a hand-anchor-ridge protrusion 72 from the portion 80, per side, on all sides circularly, as follows: Test A 0.080 inch; Test B 0.375 inch; Test C 0.160 inch; and Test D 0.160 inch, as is the preferred dimension herein. A fifth test, designated test E, was also carried out using a conventional Bettcher boning knife with the typical larger diameter gripping portion modified to include a flared ridge of 0.160 inch.

An interpretation of these five tests is set forth below.

TEST A showed that a hand-anchor-ridge of 0.080 inch is unsatisfactory event though it is far larger than the mere protrusions of reinforcement of 0.047 inch found in the prior art. Unsatisfactory, that is, unless a worker has an unusually small "heel-bone" on his hand.

TEST B showed a 0.375 inch protrusion to be too big unless the worker has an unusually large hand.

TEST C showed a 0.160 inch protrusion to give a more relaxed grip and hence less tendon strain, although workers do not express themselves usually in such technical terms as tendon strain.

TEST D verifies TEST C, demonstrating that a 0.160 inch protrusion provides a more relaxed grip and hence less tendon strain. TEST D also shows the great importance to a left-handed man of the provision for his comfort of the left-hander's lubrication hole and the provision of a left-hander's thumb-pressing position on the handle, new herein.

TEST E is of a modified prior art handpiece and shows the 0.160 inch hand-anchor-ridge hereof applied to the competitor's knife, showing it to be helpful in pulling power, meaning ease of holding onto the handle in hard pulling, hence hand-strain relief—even with the merely smooth exterior at the rear gripping portion thereof comparable to the portion 74 hereof.

The lesser comfort found shows the importance of the reduction in diameter of the rear gripping portion 74 which is a concept and discovery of this present invention.

I claim:

1. A boning knife comprising a handle, a circular blade housing secured at one portion to and extending from the handle, and a circular blade carried by the housing for rotary movement relative to the housing, said circular blade housing secured to said handle by setscrew means and by interlocking means, said interlocking means comprising slot means in said handle and insert means in and protruding outward from said slot means corresponding to slot means on the circular blade housing, said insert means held to said handle by screw means recessed in said handle.

2. The boning knife of claim 1 wherein said handle contains two threaded lubrication housing openings in the upper side thereof disposed rearwardly of said circular blade housing and disposed one on the left and one on the right side of the handle, a lubrication housing secured to one of said lubrication housing openings, and a plug sealing the other of said lubricating housing openings.

3. The boning knife of claim 1 wherein the handle has a rear gripping portion, the rearward terminal end of said handle having on its outer side an outwardly flared ridge which extends laterally of said handle from the exterior of said rear gripping portion by greater than 0.08 inch and less than 0.375 inch.

4. The boning knife of claim 3 wherein said flared ridge is at least about 0.16 inch.

5. The boning knife of claim 4 wherein said gripping portion tapers down from the flared ridge.

6. The boning knife of claim 5 wherein the diameter of the gripping portion adjacent the flared ridge is approximately 1.25 inches and the diameter of the other end of the gripping portion is approximately 1.06 inches.

7. A boning knife comprising a hollow handle, a circular blade housing secured at one portion to and extending from the handle, and a circular blade carried by the housing for rotary movement relative to the housing, said handle having a rear gripping portion, the rearward terminal end of said handle having on its outer side an outwardly flared ridge which extends laterally of said handle from the exterior of said rear gripping portion from about 0.08 to about 0.375 inch.

8. The boning knife of claim 7 wherein said flared ridge is greater than 0.08 inch and less than 0.375 inch.

9. The boning knife of claim 8 wherein said flared ridge is at least about 0.16 inch.

10. The boning knife of claim 9 wherein said flared ridge is concave on the side facing the circular blade housing.

11. The boning knife of claim 10 wherein said gripping portion tapers down from the flared ridge.

12. The boning knife of claim 11 wherein the diameter of the gripping portion adjacent the flared ridge is less than about 1.375 inches.

13. The boning knife of claim 12 wherein the gripping portion is knurled.

14. The boning knife of claim 13 wherein the gripping portion is knurled on its outer side at a depth of about 0.01 to 0.03 inch.

15. The boning knife of claim 14 wherein said handle contains two threaded lubrication housing openings in the upper side thereof disposed rearwardly of said circular blade housing and disposed one on the left and one on the right side of the handle, a lubrication housing secured to one of said lubrication housing openings, and a plug sealing the other of said lubrication housing openings.

16. The boning knife of claim 15 wherein said circular blade housing is secured to said handle by setscrew means and by interlocking means, said interlocking means comprising slot means in said handle and insert means in and protruding outward from said slot means corresponding to slot means on the circular blade housing, said insert means held to said handle by screw means recessed in said handle.

17. A boning knife comprising a hollow handle, a circular blade housing secured at one portion to and extending from the handle, and a circular blade carried by the housing for rotary movement relative to the housing, said handle having a rear gripping portion of less than about 1.375 inches diameter, the rearward terminal end of said handle having on its outer side an outwardly flared ridge which extends laterally of said handle from the exterior of said rear gripping portion from about 0.16 inch to about 0.375 inch.

18. The boning knife of claim 17 wherein said flared ridge is concave on the side facing the circular blade housing.

19. The boning knife of claim 18 wherein the diameter of the gripping portion is about 1.25 inches or less.

20. The boning knife of claim 19 wherein said flared ridge is about 0.16 inch.

* * * * *